US009228392B2

(12) United States Patent
Hermans

(10) Patent No.: US 9,228,392 B2
(45) Date of Patent: Jan. 5, 2016

(54) VENETIAN BLIND COMPRISING PAIRWISE INTERCONNECTED SLATS

(71) Applicant: JASNO INTERNATIONAL B.V., Eersel (NL)

(72) Inventor: Henricus Franciscus Theodorus Hermans, Hapert (NL)

(73) Assignee: Jasno International B.V., Eersel (NL)

( * ) Notice: Subject to any disclaimer, the term of this patent is extended or adjusted under 35 U.S.C. 154(b) by 0 days.

(21) Appl. No.: 14/395,469

(22) PCT Filed: Apr. 19, 2013

(86) PCT No.: PCT/NL2013/050296

§ 371 (c)(1),
(2) Date: Oct. 17, 2014

(87) PCT Pub. No.: WO2013/157956

PCT Pub. Date: Oct. 24, 2013

(65) Prior Publication Data

US 2015/0114576 A1 Apr. 30, 2015

(30) Foreign Application Priority Data

Apr. 19, 2012 (NL) ..... 2008663

(51) Int. Cl.

| | |
|---|---|
| ***E06B 9/32*** | (2006.01) |
| ***E06B 9/28*** | (2006.01) |
| ***E06B 9/303*** | (2006.01) |
| ***E06B 9/322*** | (2006.01) |
| ***E06B 9/324*** | (2006.01) |

(52) U.S. Cl.

CPC ... *E06B 9/32* (2013.01); *E06B 9/28* (2013.01); *E06B 9/303* (2013.01); *E06B 9/322* (2013.01); *E06B 9/324* (2013.01); *E06B 2009/285* (2013.01)

(58) Field of Classification Search

CPC ..... E06B 9/303; E06B 9/307

See application file for complete search history.

(56) References Cited

U.S. PATENT DOCUMENTS

| | | | | |
|---|---|---|---|---|
| 4,593,738 | A * | 6/1986 | Chi Yu | 160/176.1 R |
| 4,628,979 | A * | 12/1986 | Hsu | 160/115 |
| 4,651,794 | A | 3/1987 | Bytheway | |
| 4,708,188 | A * | 11/1987 | Bytheway, Jr. | 160/174 R |
| 5,232,037 | A * | 8/1993 | Fraser | 160/115 |
| 5,309,974 | A * | 5/1994 | Fraser | 160/176.1 R |
| 6,644,377 | B1 * | 11/2003 | Lewis | 160/176.1 R |
| 7,913,738 | B2 * | 3/2011 | Fraser et al. | 160/115 |
| 7,926,540 | B2 * | 4/2011 | Lai | 160/176.1 R |
| 8,267,145 | B2 * | 9/2012 | Fraser et al. | 160/115 |

(Continued)

FOREIGN PATENT DOCUMENTS

| | | |
|---|---|---|
| DE | 3510817 | 10/1985 |
| EP | 0552784 | 7/1993 |

*Primary Examiner* — Katherine Mitchell
*Assistant Examiner* — Scott Denion
(74) *Attorney, Agent, or Firm* — Eric Karich; Karich & Associates

(57) ABSTRACT

A venetian blind comprises a plurality of pairs 1 of horizontal slats 3, 5 which are connected together at the ends by means of a rope or tape 15. The Figure shows the venetian blind in partially closed position. The slats can rotate around the longitudinal axis both clockwise and anti-clockwise, so that the top or bottom respectively is rotated to the side facing the window. The venetian blind has cords to which the slats are attached with their longitudinal edges. By pulling at the cords the slats can be rotated clockwise or anti-clockwise.

6 Claims, 3 Drawing Sheets

(56) References Cited

U.S. PATENT DOCUMENTS

| | | | | |
|---|---|---|---|---|
| 8,485,242 | B2 * | 7/2013 | Fraser et al. | 160/115 |
| 2008/0262637 | A1 * | 10/2008 | Dorrough | 700/1 |
| 2009/0077874 | A1 * | 3/2009 | Oyama et al. | 47/17 |
| 2010/0071858 | A1 * | 3/2010 | Lai | 160/170 |
| 2010/0263805 | A1 * | 10/2010 | Liang et al. | 160/168.1 R |
| 2011/0214823 | A1 * | 9/2011 | Hu et al. | 160/168.1 R |
| 2013/0068402 | A1 * | 3/2013 | Shun et al. | 160/170 |

* cited by examiner

VENETIAN BLIND COMPRISING PAIRWISE INTERCONNECTED SLATS

FIELD OF THE INVENTION

The invention relates to a venetian blind comprising a plurality of horizontal slats each having a first and a second horizontal edge, and a plurality of vertical cords, of which first cords at spaced apart locations are connected to the first edges of the top slats of each pair, second cords at spaced apart locations are connected to the second edges of the top slats of each pair, third cords at spaced apart locations are connected to the first edges of the bottom slats of each pair, and fourth cords at spaced apart locations are connected to the second edges of the bottom slats of each pair, where the top slats of each pair can be rotated in a clockwise direction and in an anti-clockwise direction around their longitudinal axis by pulling up specific cords and releasing other cords, while simultaneously the bottom slats of each pair rotate around their longitudinal axis in an anti-clockwise direction and clockwise direction, respectively.

STATE OF THE ART

A venetian blind of this type is known from U.S. Pat. No. 4,651,794. A disadvantage of the known venetian blind is that in the position in which the slats are in the horizontal, open position, the free view through the venetian blind is impeded.

SUMMARY OF THE INVENTION

It is an object of the invention to provide a venetian blind of the type defined in the opening paragraph in which in open position the free view is impeded less than with the known venetian blind. To this end the venetian blind according to the invention is characterized in that the venetian blind comprises a mechanism by which the cords can be pulled up and/or released, which mechanism is arranged such that the mechanism can immobilize the first and third cords and at the same time can displace the second and fourth cords in mutually opposite directions and vice versa, so that the slats are present between a first position in which the slats of each pair are spaced apart with the first edges and with the second edges are connected to each other, and a second position in which the slats of each pair are connected to each other with the first edges and are spaced apart with the second edges.

An advantageous embodiment of the venetian blind according to the invention is characterized in that the horizontal slats are connected to each other in pairs such that alternately the two slats of each pair are connected to each other with their first or second edges, respectively.

An advantageous construction by which this can be realized is characterized in that the two slats of each pair are connected to each other by means of at least one rope or tape, while the rope or tape is present in a figure of eight shape and the slats are located in the two loops of the rope or tape.

The cords are attached to the ropes or tapes preferably in the place of or in the vicinity of the edges of the slats, so that no separate fixture to the slats is needed.

An advantageous embodiment of the mechanism of the venetian blind according to the invention is characterized in that the mechanism comprises two motors which can be driven independently of each other and which drive each a winding shaft provided with spaced apart winding drums.

Preferably, the first and third cords are wound in mutually opposite directions on each winding drum on one of the winding shafts, and the second and fourth cords are wound in mutually opposite directions on each winding drum on the other winding shaft. In lieu of this, each winding shaft may be provided with a gear and the mechanism comprises two further winding shafts which run parallel to and are spaced apart from the winding shafts and which are each provided with a further gear, which further gears are in meshing engagement with the gears on the winding shafts, where spaced apart winding drums are present on each winding shaft, on which winding drum is wound one of the cords and where all cords are wound in the same direction.

Another advantageous embodiment of the mechanism of the venetian blind according to the invention is characterized in that the mechanism comprises a transmission as well as two bodies which can be successively displaced by the transmission, where the first and third cords are connected to one of the bodies at spaced apart locations and by means of the other body the second and fourth cords are connected at spaced apart locations, where the first and third cords and the second and fourth cords respectively, run to the slats through a notch or hole in between the spaced apart locations. An advantage of this mechanism is that this can be driven by only a single motor and that, in consequence, the driving electronics only need to be simple.

Preferably, the transmission is formed by a gear that can be driven manually or by means of a motor.

BRIEF DESCRIPTION OF THE DRAWINGS

The invention will be described hereinbelow in more detail based on examples of embodiment of the venetian blind according to the invention represented in the drawing figures, in which.

DETAILED DESCRIPTION OF THE DRAWINGS

Figure 1:
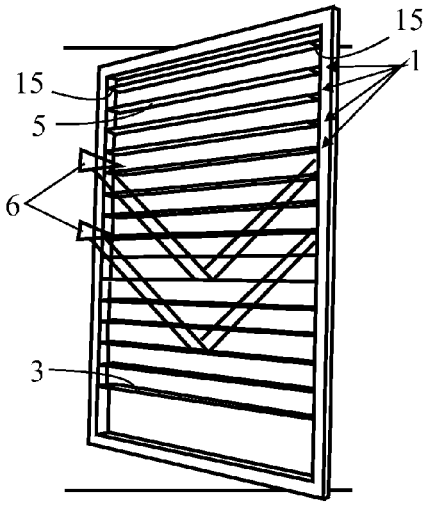
FIG. 1 shows an embodiment of the venetian blind having slats in an open, horizontal position.
Figure 2:
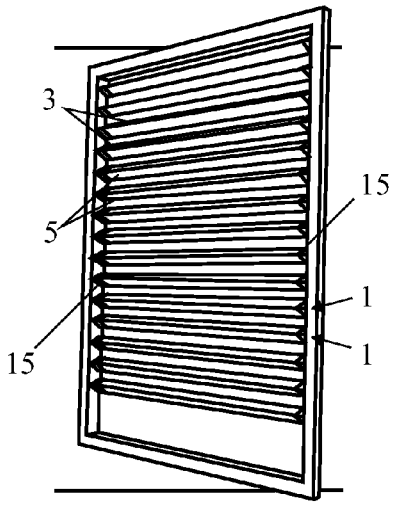
FIG. 2 shows the venetian blind shown in FIG. 1 having the slats in a partially closed position.
Figure 3:
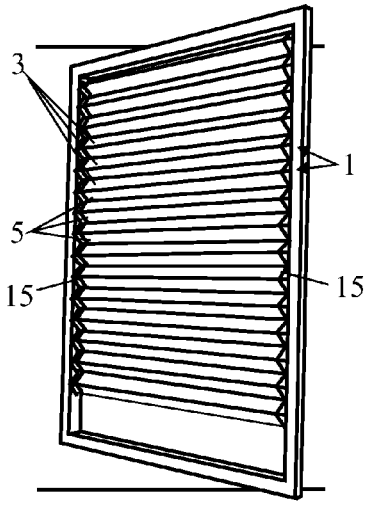
FIG. 3 shows the venetian blind shown in FIG. 1 having the slats in a completely closed position.

An embodiment of the venetian blind according to the invention is shown in the drawing figures. The venetian blind comprises a plurality of pairs 1 of horizontal slats 3, 5. The two slats 3, 5 of each pair 1 are connected to each other by a rope or tape 15 at the ends. FIGS. 1, 2 and 3 show in front of a window the venetian blind in an open position, a partially closed position and a fully closed position, respectively. The slats can be rotated around the longitudinal axis in both clockwise and anti-clockwise direction, so that the top side or bottom respectively can be rotated to the side facing the window. FIG. 1 shows by means of arrows 6 the incidence of light and reflection on the slats for illustrative purposes.

Figure 4:
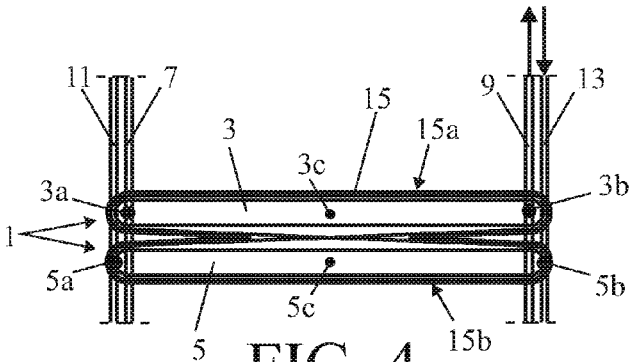
FIG. 4 shows a detailed side view of a pair of slats in an open, horizontal position.
Figure 5:
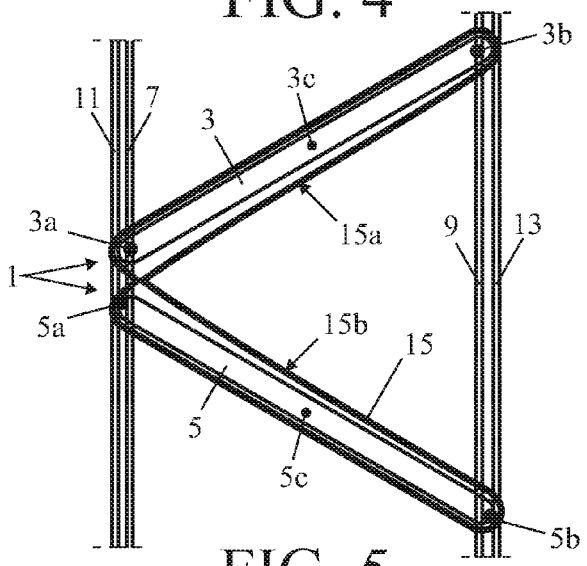
FIG. 5 shows the pair of slats shown in FIG. 4 in a first closed position.
Figure 6:
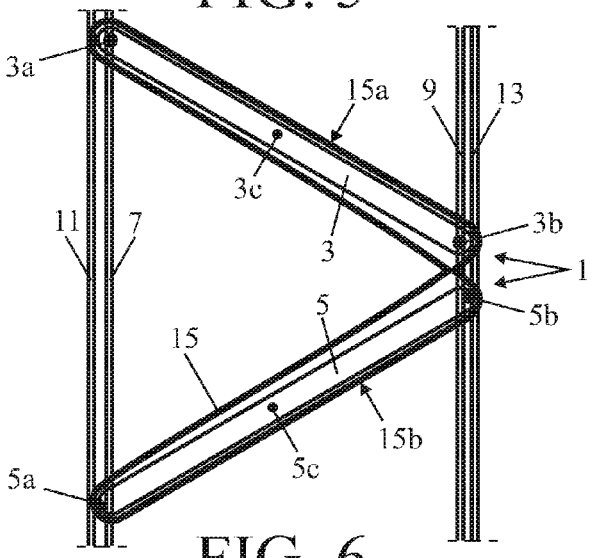
FIG. 6 shows the pair of slats shown in FIG. 4 in a second closed position.

FIGS. 4, 5 and 6 show a pair of slats of the venetian blind in side elevation in an open position and two closed positions, respectively. In the position shown in FIG. 5, the top slat is rotated clockwise and the bottom slat is rotated anti-clockwise and in the position shown in FIG. 6 the slats are rotated in opposite directions to these. The slats 3, 5 each have a first longitudinal edge 3*a*, 5*a* and a second longitudinal edge 3*b*, 5*b* to which are attached a plurality of vertical cords 7, 9, 11, 13. The cords are connected to the slats such that by pulling at the cords involved, the slats can be rotated clockwise or anti-clockwise around their longitudinal axis 3*c*, 5*c*.

The venetian blind has a mechanism (not shown) by which the cords 7, 9, 11, 13 can be pulled up and/or released, so that the slats 3, 5 between a first closed position in which the slats of each pair 1 with the first edges 3*a*, 5*a* are spaced apart from each other and are connected together with the second edges 3*b*, 5*b* (see FIG. 5), and a second closed position in which the slats of each pair 1 are connected together with the first edges 3*a*, 5*a* and with the second edges 3*b*, 5*b* are spaced apart from each other (see FIG. 6).

The mechanism is arranged such that when operated, the top slats 3 of each pair 1 can be rotated clockwise and anti-clockwise around their longitudinal axis 3*c*, while simultaneously the bottom slats 5 of each pair 1 rotate anti-clockwise and clockwise respectively around their longitudinal axis 5*c* and the two slats 3, 5 of each pair 1 are connected together with their first and second edges 3*a*, 5*a*, 3*b*, 5*b*, respectively.

The ropes or tapes 15 connecting together the two slats 3, 5 of a pair 1 are present in a figure of eight shape. The slats 3, 5 are located in the two loops 15*a*, 15*b* of the figure of eight shape. The rope or tape sections crossing each other in the middle of the figure of eight shape do not contact each other.

First cords 7 of the vertical cords are connected at locations spaced apart from each other to the first edges 3*a* of the upper slats 3 of each pair 1, and second cords 9 are connected at locations spaced apart from each other to the second edges 3*b* of the upper slats 3 of each pair 1. Furthermore, third cords 11 are connected at locations spaced apart from each other to the first edges 5*a* of the bottom slats 5 of each pair 1, and fourth cords 13 are connected at locations spaced apart from each other to the second edges 5*b* of the bottom slats 5 of each pair 1.

For rotating the slats from the position shown in FIG. 4 to the position shown in FIG. 5 the two cords 9 are to be pulled up and the fourth cords 13 are to be released. During this operation the first and third cords 7 and 11 respectively are kept still.

Figure 7:
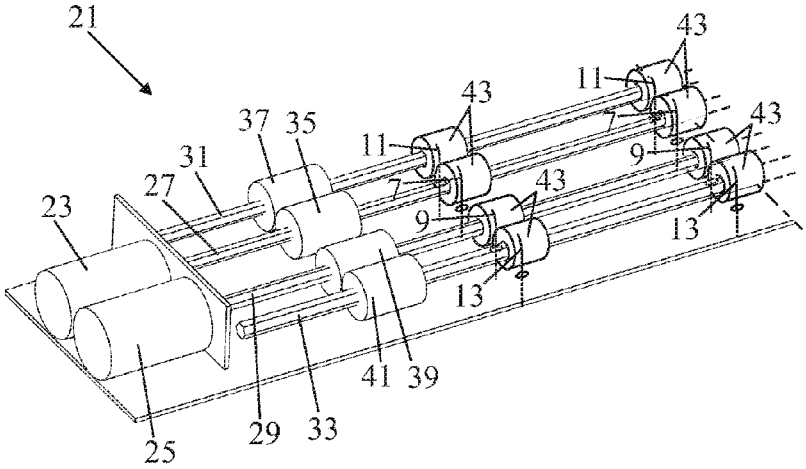
FIG. 7 shows the mechanism of the venetian blind comprising two motors.

For rotating the slats from the position shown in FIG. 4 to the position shown in FIG. 6, the first cords 7 are to be pulled up and the third cords 11 are to be released. The second and fourth cords 9 and 13 are kept still then. FIG. 7 shows a mechanism for pulling up and releasing the cords for rotating the slats. The mechanism 21 comprises two electromotors 23 and 25 driven independently of each other and each driving a winding shaft 27 and 29. The mechanism further includes two further winding shafts 31 and 33 which run parallel to and are spaced from the winding shafts 27 and 29. Each winding shaft accommodates a gear whereby the gears 35 and 37 are in meshing engagement with each other and the gears 39 and 41 are in meshing engagement with each other.

Each winding shaft accommodates a winding drum 43, which winding drums are spaced apart from each other and on which one of the cords 7, 9, 11, 13 is wound and where all cords are wound in the same direction. By driving electromotor 23, the winding shafts 27 and 31 will rotate in opposite directions to each other where for example the first cords 7 are pulled up and the third cords 11 are released. The same applies, to the other electromotor 25. With this mechanism the slats can thus be rotated in a simple manner.

In lieu of four winding shafts the mechanism can also be equipped with only the two winding shafts and no further winding shafts. In that case the first and third cords on each winding drum on the winding shaft 27 are to be wound in opposite directions to each other and the second and fourth cords 9 and 13 on each winding drum on the other winding shaft 29 are to be wound also in opposite directions to each other.

Figure 8:
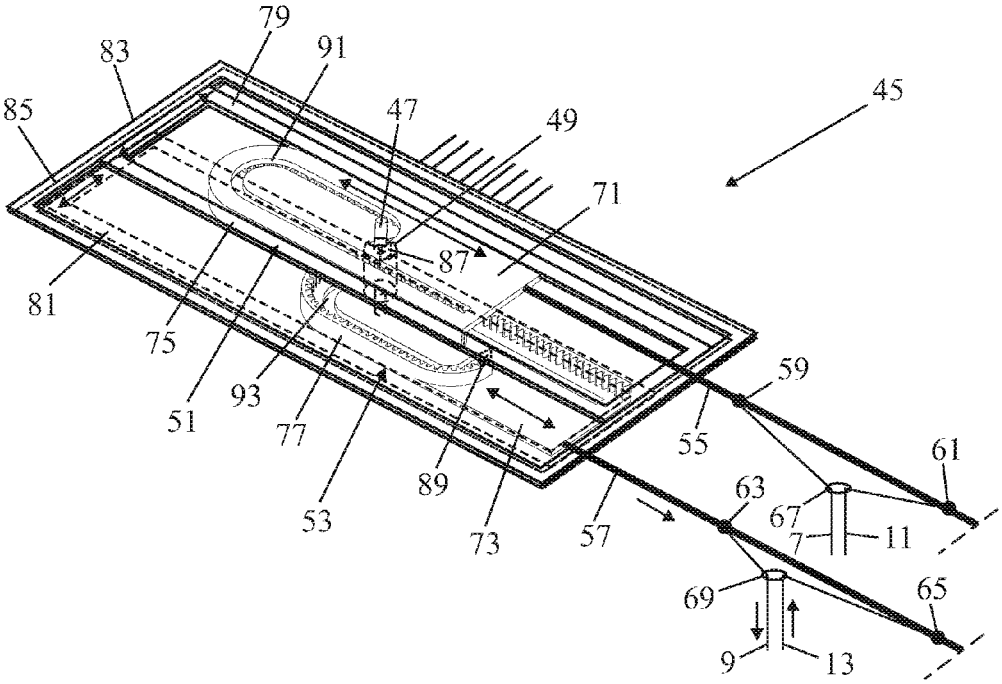
FIG. 8 shows the mechanism of another embodiment of the venetian blind comprising one motor.

FIG. 8 shows another mechanism for pulling up and releasing the cords of another embodiment of the venetian blind according to the invention. This mechanism 45 comprises only one electromotor (not shown) driving a wheel shaft 47 on which a wide gear 49 is located which successively displaces two bodies 51, 53. To each of the bodies is fixed a rod 55, 57 to which are attached first and third and second and fourth cords respectively at locations 59, 61, 63, 65 which are spaced apart from each other. The first and third cords 7, 11 and second and fourth cords 9,13 respectively lead to the slats through a hole in a plate or a notch 67, 69. These notches are present between said locations 59, 61, 63, 65 which are spaced apart from each other, so that from each pair of cords each time one of the cords is pulled up and the other cord is released.

The bodies 51, 53 are formed by two parallel strips 71, 73 which are spaced apart from each other and are provided with a toothed rack 75, 77. These strips can each be displaced in a frame 79, 81 which frames as such are slidable along a guide 83, 85 in a direction perpendicular to the direction of displacement of the slats in the frame. The toothed racks 75, 77 are located on sides of the strips 71, 73 facing each other and at one end are provided with a protuberance 87, 89 which can cooperate in a switch position of the mechanism.

The two strips are further provided with a guide slot 91, 93 each, through which the wheel shaft 47 projects to which the gear 49 is attached. As a result of a rotation of the gear and due to engagement of the gear with the toothed gear 77 of the lower body 53, the gear will displace the strip 73. The guide slot 93 provides that the gear 49 retains its meshing engagement with the toothed gear 77. At the end of the toothed gear the gear leaves its engagement. Shortly before that instant the protuberance 89 has come into contact with the protuberance 87 on the strip 71 and then slightly pushes the strip 71 to a position where the gear 49 comes into engagement with the toothed gear 75 on the upper strip 71. The lower strip 73 now comes to a halt and the upper strip 71 is displaced by the toothed gear.

The displacement of the rod 57 that is fixed to the strip 73 results in a displacement of the connecting points 63 and 65 of the cords with the rod relative to the notch 69 through which the cords run to the slats. In this operation one connecting point moves towards the notch while the other connecting point moves away from the notch and, in consequence, one of the cords 9 will be released while the other cord 13 will be pulled up. As a result of this the slat edges connected to these cords will be moved away from each other or towards each other so that the venetian blind is closed or opened, respectively.

Albeit the invention has been described in the foregoing based on the drawing figures, it should be observed that the invention is not by any manner or means restricted to the embodiments shown in the drawing figures. The invention also extends to all embodiments deviating from the embodiments shown in the drawing figures within the spirit and scope defined by the claims. For example, the venetian blind may also be equipped with a pull-up mechanism (cord that goes down through holes in the middle of the slats or through loops or rings on the ropes or tapes 15 and is attached to the bottom slat) for raising the slats.

Furthermore, in lieu of the strips the mechanism may also comprise two gears with are provided with command slots with cam followers which have rods connected thereto. These gears are driven by worm wheels which are connected via a transmission to a drive shaft that is driven by a motor. The coupling of the one worm wheel that drives the one gear is realised by a rod via the command slot in the other gear, so that here too the two gears are driven successively. The cords are then connected to the gears in such a way that they are pulled up and released in the desired manner.

What is claimed is:

1. A venetian blind comprising:

a plurality of horizontal slats, each comprising a longitudinal axis, a first horizontal edge, and a second horizontal edge, the horizontal slats being connected to each other in pairs each comprising a top slat and a bottom slat;

a plurality of vertical cords, including first cords at spaced apart locations connected to the first horizontal edges of the top slats of each pair of horizontal slats; second cords at spaced apart locations connected to the second horizontal edges of the top horizontal slats of each pair of horizontal slats; third cords at spaced apart locations connected to the first horizontal edges of the bottom horizontal slats of each pair of horizontal slats, and fourth cords at spaced apart locations connected to the second horizontal edges of the bottom slats of each pair of horizontal slats;

wherein the top horizontal slats of each pair of horizontal slats can be rotated around the longitudinal axis in a clockwise direction by pulling up the first cord and releasing the second cord and simultaneously the bottom slats of each pair of horizontal slats rotates around the longitudinal axis in a counter-clockwise direction by pulling up the fourth cord and releasing the third cord;

wherein the top horizontal slats of each pair of horizontal slats can be rotated around the longitudinal axis in a counter-clockwise direction by pulling up the second cord and releasing the first cord and simultaneously the bottom slats of each pair of horizontal slats rotates around the longitudinal axis in a clockwise direction by pulling up the third cord and releasing the fourth cord; and a means for performing said pulling up or said releasing of the cords such that the first and third cords can be immobilized and at the same time the second and fourth cords can be displaced in mutually opposite directions, and such that the second and fourth cords can be immobilized and at the same time the first and third cords can be displaced in mutually opposite directions, so that each of the pairs of horizontal slats can move between a first position in which the first horizontal edges are spaced apart from each other and the second horizontal edges are adjacent to each other, and a second position in which the first horizontal edges are adjacent each other and the second horizontal edges are spaced apart from each other.

2. The venetian blind of claim 1, wherein the means for said immobilizing and said releasing the cords comprises a mechanism comprising two motors which can be driven independently of each other, one of the two motors drives a first winding shaft and the other of the two motors drives a second winding shaft, each of the first and second winding shafts is provided with spaced apart winding drums.

3. The venetian blind of claim 2, wherein the first and third cords are wound in mutually opposite directions on each winding drum on one of the first and second winding shafts, and the second and fourth cords are wound in mutually opposite directions on each winding drum on the other of the first and second winding shafts.

4. The venetian blind of claim 3, wherein the first winding shaft is provided with a first gear and the second winding shaft is provided with a second gear and the mechanism comprises a third and a fourth winding shaft which third and fourth winding shafts run parallel to and are spaced apart from the first and second winding shafts and which third shaft is provided with a third gear and the fourth winding shaft is provided with a fourth gear, which third gear is in meshing engagement with the first gear and which the fourth gear is in meshing engagement with the second gear, where spaced apart winding drums are present on each of the third and fourth winding shafts, on each of the winding drums is wound one of the cords and where all cords are wound in the same direction.

5. The venetian blind of claim 1, wherein the means for said immobilizing and said releasing the cords comprises a mechanism comprising a transmission as well as two bodies which can be displaced one after the other by the transmission, where the first and third cords are connected to one of the bodies at spaced apart locations and by an other of the two bodies the second and fourth cords are connected at spaced apart locations, where the first and third cords between their ends go through a notch or hole present between the spaced apart locations and the second and fourth cords go through a further notch or further hole present between the spaced apart locations.

6. The venetian blind of claim 5, wherein the transmission is formed by a gear that can be driven manually or by a motor.

* * * * *